US005750928A

United States Patent [19]

Escallier

[11] Patent Number: 5,750,928

[45] Date of Patent: May 12, 1998

[54] METHOD OF FABRICATION OF ELECTRICAL CABLE CONNECTOR, ELECTRICAL CABLE, AND HIGH-VOLTAGE TRANSFORMER EQUIPPED WITH SUCH CABLES

[76] Inventor: Bernard Escallier, 18b rue Majnoni d'Intignano, F-21121 Fontaine-les-Dijon, France

[21] Appl. No.: 572,327

[22] Filed: Dec. 14, 1995

[30] Foreign Application Priority Data

Jan. 5, 1995 [FR] France ..... 95 00070

[51] Int. Cl.[6] ..... H01R 4/00; H01F 15/10; H01F 27/04

[52] U.S. Cl. ..... 174/84 R; 29/860; 29/879; 336/107; 336/192

[58] Field of Search ..... 29/860, 879, 880; 174/90, 94 R, 84 R, 74 R, 82; 336/192, 107

[56] References Cited

U.S. PATENT DOCUMENTS

| | | | |
|---|---|---|---|
| 3,798,589 | 3/1974 | Deardurff | 174/74 R |
| 4,730,086 | 3/1988 | Kamijo et al. | 124/74 R |

*Primary Examiner*—Thomas J. Kozma
*Attorney, Agent, or Firm*—Joseph S. Tripoli; Frederick A. Wein

[57] ABSTRACT

The disclosure relates to a flexible-core electrical cable whose end is stripped and carries a metal disk of diameter not exceeding that of the cable sheathing and having a central hole. The disk is fitted against the end of the sheathing with the core passing through the central hole. Conducting solder is applied to rigidify the flexible core and attach it mechanically to the disk. The invention is applicable to flexible-core high-voltage cables, in particular those used on high-voltage transformers fitted with conducting connection pellets.

9 Claims, 2 Drawing Sheets

METHOD OF FABRICATION OF ELECTRICAL CABLE CONNECTOR, ELECTRICAL CABLE, AND HIGH-VOLTAGE TRANSFORMER EQUIPPED WITH SUCH CABLES

FIELD OF THE INVENTION

The invention concerns the field of electrical cables, in particular electrical cables with a flexible conducting core. The invention also concerns high-voltage (HV) transformers equipped with external high-voltage electrical cables to supply for example electrical components in an electrical device, such as a television set.

BACKGROUND OF THE INVENTION

In the field of HV transformers the establishment of the electrical connection between the HV outputs of the transformer and external HV electrical cables was a source of problems for many years.

A simple and satisfactory solution has recently been proposed in the European patent no 0 236 642. This solution is to introduce soft silicone pellets containing conducting powder into the insulating casing of the transformer. These provide an electrical interface between the HV outputs of the transformer's coils and the external connecting cables. To make the electrical connection, the ends of internal and external conductors are pushed into these silicone pellets.

This solution is reliable only if the cables penetrating the silicone conducting connection pellets are sufficiently rigid to be inserted into the pellets and completely immobilized (possibly repetitively, if this is necessary). For this reason, the cables used in the patent mentioned previously have a rigid core.

However, it may be preferable or advantageous in some cases to use cables with a flexible core instead of a rigid core. This is the case, for example, when the HV transformer is used in a confined space (within a TV set, for example), since flexible cables can be positioned more freely that rigid ones. Moreover, in view of the high voltages (as much as 50 KV), safety standards require that the insulating casing of the transformer includes safety "chimneys" protruding from the casing in order to separate the connection points (the conducting pellets, for example) between the HV outputs of the transformer coils and the ends of the external HV cables from neighboring components. This required separation distance determines the height of the chimneys. The HV cables exiting these chimneys tend to increase the overall dimension of the transformer in the direction of the chimneys. It is clear that this increase is less with flexible cables than with rigid cables: the more the cables are flexible, the less will be the additional height required by them above the transformer.

It would be possible to attach to the stripped end of the flexible core an electrical terminal crimped onto the cable sheathing in order to enable the use of flexible-core cable on HV transformers containing conducting pellets. This terminal would however increase the overall radial size of the cable, which would be unacceptable in certain applications, notably the clipping of the cable according to the technique described in the European patent no 0 236 642.

SUMMARY OF THE INVENTION

The present invention provides a simple and effective solution to this problem enabling the flexible conducting core of electrical cables to be rigidified to enable their use notably in HV transformers containing conducting connection pellets.

Another object of the invention is a method of fabrication of a rigid connector for flexible-core electrical cable.

Another object of the invention is flexible-core electrical cable of which at least one end is rigidified in a special manner.

Another object of the invention is a high-voltage transformer fitted with flexible electrical cables of which one end of the core is rigidified in order to enable it to be easily inserted in the silicone conducting connection pellets of the transformer.

Another object of the invention is a method of fabrication of a connector on a flexible-core electrical cable according to the invention, characterized in that it involves the following steps:

- stripping one end of the cable by removing the protective plastic sheathing around the flexible core,
- fitting on this stripped end of the cable a metal disk that is pressed against the sheathing of the cable, this disk having a diameter not exceeding that of the cable sheathing, and a central hole through which the flexible core of the cable passes,
- depositing conducting solder on the flexible core to rigidify it and attach it to the metal disk.

According to the invention, a flexible-core electrical cable is protected by an insulating plastic sheathing. One end of the cable is stripped by removal of the sheathing from the core. A metal disk with a hole in the middle and of diameter not exceeding that of the sheathing is placed around the stripped core, the disk being pressed against the end of the sheathing. Conducting solder is then deposited on the stripped core, rigidifying it and attaching it mechanically to the metal disk.

The disk preferably includes barbs on its surface that are positioned towards the sheathing such that they penetrate the sheathing, thus providing at least temporary immobilization of the disk on the cable. The barbs can be produced by stamping the disk and can be located at regular intervals around a circle concentric with the central hole of the disk. The central hole is advantageously delimited by a tapered collar that assures the centering of the disk on the core and also reinforces the cohesion of the assembly once the solder has been applied.

The HV transformer according to the invention includes a coil enclosed in an insulating casing, soft conducting pellets into which the conducting outputs from the transformer's coils are inserted, and flexible HV cables whose stripped ends are rigidified as described above and are also inserted into the conducting pellets.

BRIEF DESCRIPTION OF THE DRAWINGS

The invention will be better understood on reading the following detailed description of a preferred, though non-limitative embodiment, making reference to the appended figures, of which:

FIG. 1 shows an HV transformer of the type described in the European patent no 236 642, with flexible-core HV electrical cables. The transformer 1 can be used to power the cathode ray tube (CRT) of a television. It included a magnetic circuit 2, a coil 3 with several windings, and electrical connectors 4 between the coil 3 and another electrical component (not shown). The coil 3 has two HV outputs, one of which powers the grids of the CRT (not shown) via a potentiometer block (not shown), the other powering the anode of the CRT. Flexible HV cables 5, 6 provide the connections to the HV voltages on the outputs of the coil 3.

Figure 1:
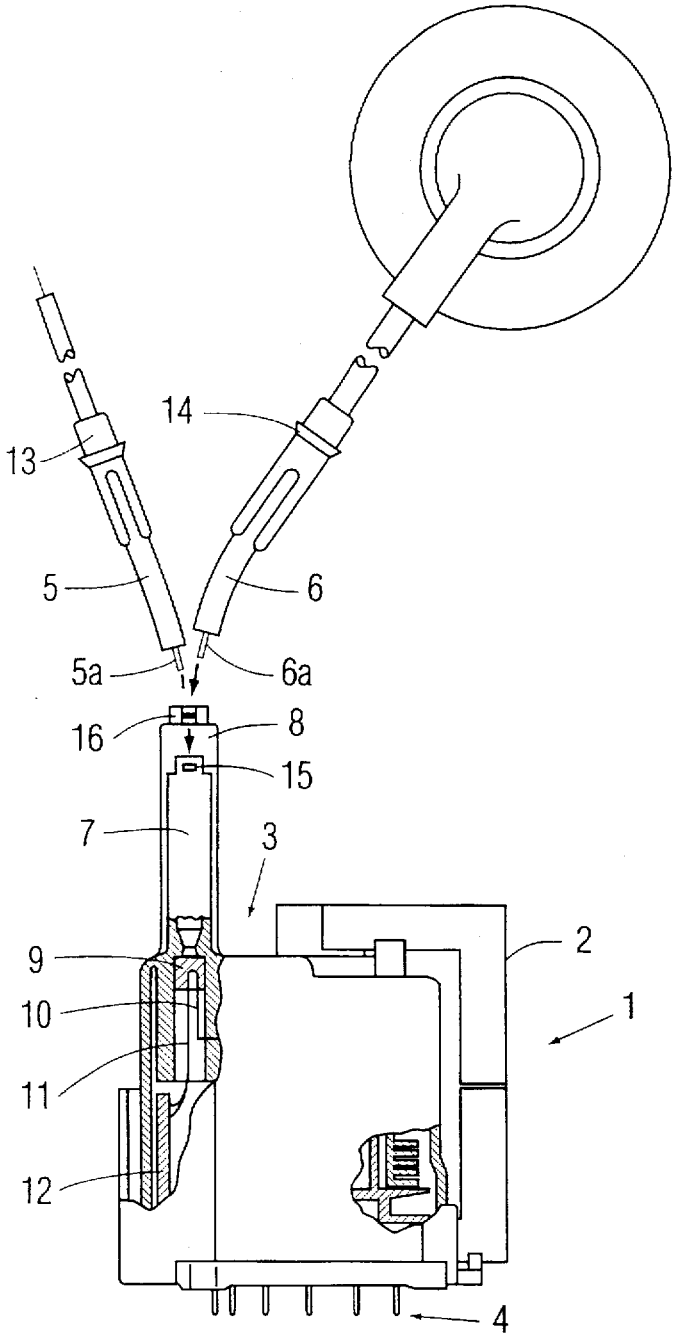
FIG. 1 shows a high-voltage transformer of the type fitted with conducting connection pellets, according to the invention.

The coil 3 has a protective casing made of resin that has two safety chimneys 7, 8 intended to receive the stripped, rigidified ends 5*a*, 6*a* of the cables 5, 6 (the rigidification technique is described below). The height of the chimneys 7, 8 depends on the output is voltage of the corresponding transformer outputs. In each chimney 7, 8 there is a pellet 9 of silicone containing conducting powder that enables the electrical connection between the HV output 10 of the transformer coil 3 and the stripped, rigidified end 5*a* of the corresponding cable 5. The electrical connection between the HV output 10 and the stripped end 5*a* of the cable 5 is made by pushing this end 5a and the output conductor 10 into the conducting pellet 9.

The lower face of the conducting pellet 9 is advantageously pushed onto the end of a conductor 11 connected to a load resistor 12 known as a "bleeder". The same remark applies to the pellet (not shown) in chimney 8.

In order to assure the mechanical gripping of the HV cables 5, 6 in the chimneys 7, 8, so that they resist axial pulling forces and thereby assure the reliability of the electrical connection, each cable 5, 6 is fitted in a cable grip member 13, 14 that clips onto and engages the ends 15, 16 of the chimneys 7, 8.

Figure 2A:
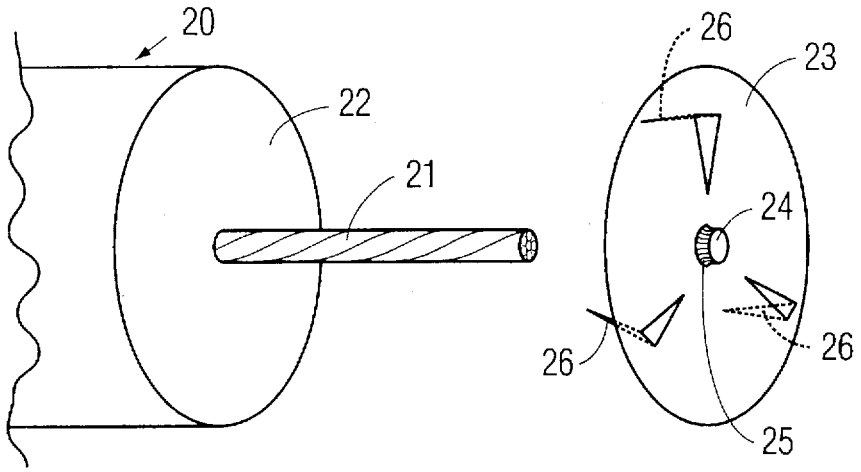
FIG. 2*a* is an exploded diagram of the end of a flexible-core electrical cable and a metal disk, according to the invention.
Figure 2B:
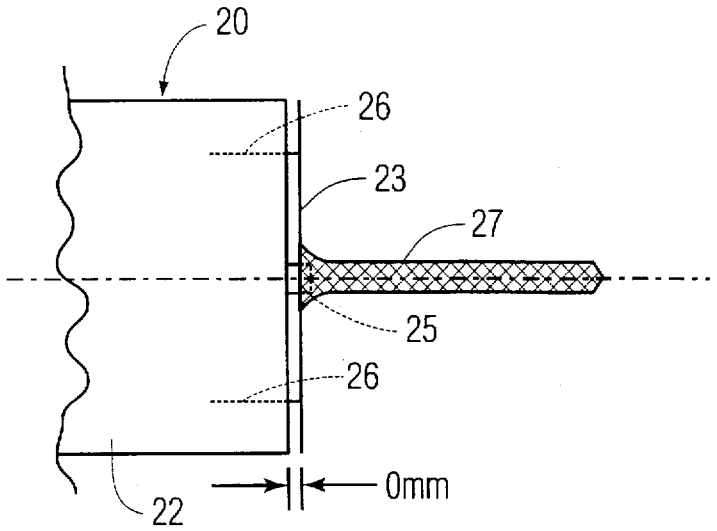
FIG. 2*b* is an side view of the cable of FIG. 2*a* after assembly.

We shall now explain in detail the assembly of the rigidified ends 5*a*, 6*a* of the HV cables 5, 6, with reference to FIGS. 2*a* and 2*b*.

The flexible cable 20 includes a flexible, conducting, twisted multiwire core 21 and an insulating sheathing 22 of flexible plastic material surrounding the flexible, conducting core 21. One end of the cable 20 is stripped by removal of the sheathing 22 from the flexible core 21. A thin, flat metal disk 23 has a diameter not exceeding that of the sheathing 22 and a central hole 24 delimited by a tapered collar 25, and also has several barbs 26 produced by stamping the disk 23. The barbs 26 are preferably located at regular intervals around a circle concentric with the central hole 24 of the disk 23. They are oriented perpendicularly to the disk and pointing in the opposite direction from the tapered collar 25.

The flexible conducting core 21 of the cable 20 is inserted in the central hole 24 of the disk 23 with the barbs 26 pointing towards the sheathing 22. These barbs 26 penetrate the sheathing 22 axially until the disk is pressed against the sheathing 22 (in FIG. 2*b* the disk is shown slightly separated from the sheathing for reasons of clarity). The penetration of the barbs 26 in the sheathing 22 ensures that the disk is held firmly on the cable, and the tapered collar 25 ensures that the disk 23 is centered on the flexible core 21.

Next, conducting solder is deposited on the core 21, for example by soldering using a lead-tin alloy. The molten solder penetrates the multiwire core by capillary action and covers the tapered collar 25. When the solder cools, the result is a rigidified conducting end 27 of the cable 20 that is solidly attached to the metal disk 26. This conducting end 27, of "T" section, is resistant to buckling, which improves its mechanical characteristics when the cable 20 is pushed into the conducting pellet 9.

By choosing a diameter of the disk 23 that does not exceed that of the sheathing 22 of the cable 20, the cable may still be clamped using the cable grip system 13–16 shown in FIG. 1.

The method according to the invention provides a very simple means of enabling flexible electrical cables to be employed in applications where, in principle, rigid cable is necessary, in particular in cases where the flexibility of the cable core makes the establishment of an electrical connection difficult.

What is claimed is:

1. Method of fabrication of a connector on a flexible-core electrical cable comprising the following steps:

stripping one end of the cable by removing the protective plastic sheathing around the flexible core, fitting on this stripped end of the cable a metal disk that is pressed against the sheathing of the cable, this disk having a diameter not exceeding that of the cable sheathing, and a central hole through which the flexible core of the cable passes, depositing conducting solder on the flexible core to rigidify it and attach it to the metal disk.

2. Method according to claim 1, wherein said rigidification of said flexible core is obtained by soldering using a lead-tin alloy.

3. Flexible-core electrical cable sheathed with a plastic insulating material, of which one end is stripped by removal of the sheathing from the flexible core which carries a metal disk of diameter not exceeding that of the cable sheathing and having a central hole, the disk being fitted against the end of the sheathing with said flexible core passing through the central hole, the core being at least partially coated with a conducting solder that rigidifies it and attaches this rigidified core mechanically to the disk.

4. Electrical cable according to claim 3, wherein the face of said metal disk in contact with the sheathing carries barbs that penetrate the sheathing axially.

5. Electrical cable according to claim 4, wherein said barbs are made by stamping said metal disk and are oriented perpendicular to the surface of said disk.

6. Electrical cable according to claim 4, wherein said barbs are located at regular intervals around a circle concentric with said central hole of said metal disk.

7. Electrical cable according to claim 5, wherein said metal disk is flat and thin.

8. Electrical cable according to claim 3, wherein said metal disk has a tapered collar located around said central hole and located on the opposite side of said disk from said cable sheathing.

9. Electrical cable according to claim 3, wherein said flexible core is of twisted multiwire type.

* * * * *